US008289594B2

(12) United States Patent
Drinkwater

(10) Patent No.: US 8,289,594 B2
(45) Date of Patent: Oct. 16, 2012

(54) DATA PROTECTION STRUCTURE

(75) Inventor: John Drinkwater, Fleet Hampshire (GB)

(73) Assignee: Optaglio Limited, Andover Hampshire (GB)

( * ) Notice: Subject to any disclaimer, the term of this patent is extended or adjusted under 35 U.S.C. 154(b) by 704 days.

(21) Appl. No.: 12/300,312

(22) PCT Filed: May 9, 2007

(86) PCT No.: PCT/GB2007/050246

§ 371 (c)(1), (2), (4) Date: Jul. 13, 2009

(87) PCT Pub. No.: WO2007/129123

PCT Pub. Date: Nov. 15, 2007

(65) Prior Publication Data

US 2009/0303558 A1 Dec. 10, 2009

(30) Foreign Application Priority Data

May 10, 2006 (GB) ..... 0609261.3

(51) Int. Cl.
*G03H 1/00* (2006.01)
*B42D 15/00* (2006.01)

(52) U.S. Cl. ..... 359/2; 283/101

(58) Field of Classification Search ..... 359/2; 283/72, 283/86, 100, 101, 111
See application file for complete search history.

(56) References Cited

U.S. PATENT DOCUMENTS

| | | | | |
|---|---|---|---|---|
| 4,643,454 | A * | 2/1987 | Ondis | 283/74 |
| 2005/0243391 | A1 * | 11/2005 | Drinkwater | 359/31 |
| 2006/0006639 | A1 * | 1/2006 | Taylor et al. | 283/49 |

FOREIGN PATENT DOCUMENTS

| | | | |
|---|---|---|---|
| CA | 2471024 | A1 | 9/2004 |
| DE | 10211213 | A1 | 10/2003 |
| WO | WO/02/093474 | A | 11/2002 |
| WO | PCT/GB2007/050246 | | 5/2007 |

* cited by examiner

*Primary Examiner* — Alessandro Amari
(74) *Attorney, Agent, or Firm* — Kilpatrick Townsend & Stockton LLP

(57) ABSTRACT

The present invention provides for a data protection device comprising an optically variable diffractive scratch-layered structure overlying data to be protected, wherein the device includes at least first and second opaque metallic layers separated by a flexible light-absorbing separation layer.

11 Claims, 3 Drawing Sheets

DATA PROTECTION STRUCTURE

FIELD OF THE INVENTION

Optically variable diffractive structures and devices such as holograms and optical interference based devices are now used to prove the authenticity of items of value and to prevent their fraudulent duplication for example for banknotes, plastic cards, value documents such as fiscal stamps, travel documents such as passports and for the authentication of valuable goods as an anti-counterfeit measure. Scratch-off inks, scratch-off hot foils and scratch-off labels are used to protect hidden numbers which can be revealed by scratching off the soft adhesive or ink layer—for example on lottery tickets for number protection and for protecting secure validation numbers on validation cards, such as pre-pay telephone cards. Scratch-off diffractive and holographic hot stamping foil is also used in this type of application with the advantage that the holographic foil is hard to replicate or obtain and therefore protects the number from alteration or prior use and re-sale.

This invention relates to an optically variable diffractive scratch-off foil with very high opacity designed to defeat number reading of scratch cards by transmissive techniques particularly useful in the area of anti-counterfeit and authentication by the diffractive image and data protection using scratch-off foils. These scratch-off foils are also tamper evident against removal and alteration as the holographic image is destroyed by any attempt to remove the device. These techniques can also be used to provide increased opacity scratch-off labels.

BACKGROUND OF THE INVENTION

These applications are particularly applicable to scratch cards for phone-cards and lottery tickets, vouchers and other items of value where a PIN number is protected by a scratch-off foil and revealed by scratching off the foil.

Devices based on the principle of optical diffraction are often used for anti-counterfeit and security purposes because they can produce, by the process of optical diffraction, an optically variable image with characteristic features such as depth and parallax (holograms) and movement features and image switches (purely diffraction grating devices and some holographic devices). Such diffractive, optically variable image forming devices are used as anti-counterfeit devices both because their effects are highly recognisable and cannot be duplicated by print technologies, and because specific and difficult to replicate optical and engineering techniques are required for their production.

These diffractive optically variable image forming devices form their effects base on holographic or pure diffraction grating techniques and are often manufactured as embossed surface relief structures as known in the art (for example, Graham Saxby, Practical Holography Prentice Hall 1988). They are typically applied to documents of value, plastic cards and articles of value to be protected in the form of holographic or diffractive hot stamping foil applied to a numbered paper or plastic card base using the known method from the printing industry of the technique of hot stamping of decorative foils.

There are various forms of pure diffraction grating devices in use as such security devices, examples include U.S. Pat. No. 4,568,141, which reveals a diffraction optical authenticating element and U.S. Pat. No. 5,034,003 which reveals another form of optical security device using diffraction gratings. Another form of pure diffraction grating security device can be produced by direct writing by an electron beam and examples are WO 9318419, WO 9504948 and WO 9502200. Teachings on methods of origination useful for dot screen hidden image for example using electron beam lithography can be found in PCT/GB/2002/003257, useful teachings on methods of recording and replaying covert laser readable features using both laser interference and direct write origination can be found in WO 02/03323 A1, WO 02/02351 A1 and WO 02/03109 A1 and useful methods for originating achromatic structures can be found in WO 02/06858 A2—the teachings of all which are incorporated by reference. Diffractive optical variable image forming devices can also be produced by holographic methods and are known by their use in security applications for example on credit cards, secure documents and product authentication—examples of such teachings are U.S. Pat. No. 5,694,229, U.S. Pat. No. 5,483,363, WO 995903.

Currently various approaches have been used for securing PIN data on product and documents. These include tamper evident security scratch-off foils and scratch-off security labelling using anti-counterfeit features such as holograms, diffractive devices, or various forms of security print.

It is often advantageous and known in the art to protect hidden numbers on pre-pay cards or lottery tickets by scratch-off ink systems, where the ink covering the ticket or validation number can be scratched-off using for example a coin but which keeps the number or information completely hidden until usage. Scratch-off diffractive and holographic hot stamping foil is used in this type of application to protect information of value from prior disclosure or alteration—with the advantage that the holographic foil is hard to replicate or obtain and therefore protects the number from alteration or prior use and re-sale. In these applications the hot stamping device would be opaque to prevent viewing of underlying data—usually metallised with aluminium or a similar reflective and opaque metal which can be scratched off to reveal the data. Scratch off ink systems can be combined with an overlaid metallic or holographic metallic layer and some types are described for example in WO 2006/005156 A1 (Taylor et al) which describes a scratch card system consisting of a secure number overlaid by a printed varnish, a soft adhesive and with a metallic or holographic foil applied on top, one method of application being foil stamping or cold foil transfer. Other such systems are described in CA 2 471 024 A1 (Hamilton et al).

Another class of scratch-off protection is provided by scratch-off hot stamping foils, either printed or scratch-off holographic foil, applied and transferred over the number to form a thin frangible layer where the hologram is destroyed by tampering and where the holographic scratch foil is opaque to read-through by optical techniques relying on the transmission of high intensity light sources. Scratch-off hot stamping foils including holographic scratch off foils are routinely commercially available from a number of sources including Leonhard Kurz GmbH and Optaglio Limited and these devices typically include a holographic layer, a heat activated soft scratch off adhesive designed to be heat applied to the card substrate under typical hot foil stamping parameters. In these scratch-off holographic foils, the adhesive can be high opacity (black) using typically graphite powders or lower opacity (white, using alternative fillers) to reduce smear as the adhesive breaks up on removal as noted and described in WO 02/093474 A1. Often the aluminium reflective layer is used to provide enhanced opacity and is produced by vacuum metallising relatively thick layers of aluminium to increase the light blocking capability. Multi layer scratch off foils (where different adhesive or foil layers have different properties) are well known in the general foil and hot stamping foils field—for example banknote or cards grades of hot stamping contain scratch resistant hard layers, emboss lacquer layers and then optionally hard protective layers underneath the emboss and metallization layers and then often a multi-layer adhesive consisting of a first, or primer, layer and a main heat-activated adhesive layer. A commercially available holographic scratch off foil from Leonhard Kurz comprises a layer structure containing an emboss lacquer, metallisation layer then a layered adhesive consisting of a soft easily removed scratch off layer, followed by a hard durable layer to protect the underlying data from damage followed by a heat activated adhesive layer to bind the structure onto the PIN panel area during transfer.

One known form of attempted number-compromise of scratch cards, such as phone-cards, is to use an intense light source which in some cases can allow the numbers to be read in transmission. This is regarded as a serious form of potential compromise since the secure number potentially can be read and used non-destructively and then the card sold on as genuine.

It is known in the field to produce improved scratch foils with high opacity by using very high opacity metallised layers typically aluminium, sometimes produced by multiple passing of the foil through a metalliser to increase the overall thickness of the aluminium layer to increase the opacity. It is known by this method to produced enhanced opacity scratch foils to defeat light transmission compromise and it is also known to conduct forensic tests that will measure the resistance of the card to light transmission typically conducted on flat cards.

A typical manufacturing technique for a current generation high opacity foil involves embossing a holographic hot stamping foil, aluminising the foil in a vacuum metalliser to give a high opacity aluminium layer and then coating the foil with scratch-off adhesive in a wet coating machine using typical solvent and other coating techniques such as meyer bar, direct gravure and reverse gravure. For more advanced structures the vacuum coating can potentially place an aluminium layer to increase the opacity of the foil, and the wet coating process potentially layering the scratch-off adhesive layers to give various properties on the scratch foil layer. This material would typically be slit and then applied by a process of hot stamping—which releases the hot stamped release layer from the PET carrier to transfers the scratch adhesive layer and the aluminium layer and holographic emboss lacquer and image onto a substrate to form a thin holographic scratch-off coating over a PIN number.

There is an additional light transmission test, or potential attack, that involves the card substrate being additionally bent (distorted). In some cases with scratch foils when the card and scratch foil is bent and curved and stretched (typically the card is curved to stretch and crack the metal reflector of the holographic scratch-off coating) causing a set of micro-cracks form in the aluminium layer can reduce the opacity of the metal layer and thus allow light leakage and visualisation of the data. Thicker aluminium films created by multiple aluminium coatings tend to increase the overall opacity but may still tend to become cracked and crazed when sufficiently stretched by card distortion. This means that single layer aluminium layers can be prone to reduced opacity under bending by micro cracking the aluminium layer to allow a small amount of light transmission.

SUMMARY OF THE INVENTION

The present invention seeks to provide for a data protection structure having advantages over known such structures.

A particular further objection of the invention is to provide an improvement upon the above holographic scratch-off foil devices by providing a new type of holographic scratch foil structure with improved high opacity and a device which increases the opacity against one particular form of attack where existing holographic scratch foils have been shown to be weak allowing the number to be read through.

According to the first aspect of the present invention there is provided a data protection device comprising an optically variable diffractive scratch-layered structure overlying data to be protected, wherein the device includes at least first and second opaque metallic layers separated by a flexible light-absorbing separation layer.

Further, there can be provided a structure of scratch-off foil where the layers are adjusted to enable the foil to withstand severe bending of the and foil by making the aluminised layer resistant to micro cracking and light transmission and so to enable a pass on a test involving light transmission when bent. This is achieved by using two or more separated aluminium layers within the structure separated by a few micron layer (3-8 micron) of high opacity black frangible scratch off coating which increase the flexibility of the structure and allows the aluminium layers to stretch and crack but ensures that because two (or more) aluminium films are involved the cracks tend not line up in transmission and hence the overall light through put though the cracks is greatly reduced. The black (high opacity) frangible scratch off adhesive interlayer serves to reduce the transmission of any light leakage through none aligned cracks in the two aluminium layers and keeps the overall structure capable of being easily broken up for scratch off and need to be of an optical density (for the 3-8 um layer) of at least O.D. 2.5 or above. The black light absorbing interlayer needs to be above a certain thickness to allow sufficient light blocking and also to impart some flexibility to the structure and to impart a cushion affect to allow the two aluminium films to move independently when bend distorted and cracked. After the layered aluminium light blocking layer would be added standard scratch off adhesives as known in the art to adherer the scratch off transfer structure to the substrate.

In one embodiment, this first 'inter-layer' of scratch-off adhesive has a high optical density which is typically obtained through appropriate carbon dispersion in the adhesive. The inter-layer is as black as possible to eliminate light seepage by multiple reflections between the layers.

A typical exemplary construction would then be—hot stamping foil carrier (PET), release, then the layers transferred onto card namely emboss lacquer carrying micro replicated surface relief diffractive image, a first metallised aluminium layer (optionally multiple coated to increase opacity), first light absorbing high opacity intermediate black soft scratch-off adhesive spacer layer to add elasticity and absorption, of thickness in the region 0.5-6 microns or indeed 3-8 microns, typically one form of high opacity, high carbon loading black scratch-off adhesive is used, a second metallised aluminium layer (optionally one or more coatings) to add opacity under bending conditions, the second scratch-off adhesive layer to affix scratch foil over the PIN number, typically 4-13 um thickness.

The structure is characterised as containing two or more separate aluminium layers separate by a small distance using a flexible light absorbing separation layer to allow the aluminium layers to crack in different places under stretching and bending after application to maintain opacity under bending.

In various embodiments metals other than aluminium could give different effects, for example, copper for a gold effect, or alloys such as an alloy of copper—aluminium also for a gold effect or chrome for darker effect or chrome aluminium alloys.

The invention therefore provides for a high opacity scratch-off foil opaque to high intensity light transmission under bending, stretching, and general deformation conditions, characterised in that the foil construction consists of two (or more) separate aluminium layers, separated by a light absorbing separator layer of thickness 3-8 um layers typically, of high opacity light absorbing scratch-off adhesive with a final coating of standard scratch-off adhesive.

In particular, there is provided a construction similar to the above using more than two layers, for example three, of metal and spacer layers to further increase opacity.

The invention can provide for a scratch-off foil construction as above with an enhanced tape test protection to number access by ensuring that the first high opacity scratch-off adhesive, layer on the holographic surface is less well bonded than the lower scratch of layer, thus resulting at de-lamination or partial de-lamination at this layer when tape access to number is attempted to keep number still hidden under second metal layer.

Of course the invention also includes any scratch card, phone-card, lottery ticket, or any other value item employing such a scratch-off foil construction and which can provide for enhanced opacity under bending stresses.

The invention also provides for a scratch-off label comprising a scratch-off foil applied to a suitable tamper-evident substrate with an enhanced opacity when subjected to bending deformation and containing the same scratch-off layer structure as above.

It is noted that the invention provides metal layers with light absorbing scratch off spacer layers to provide a material of enhanced opacity and enhanced bend resistance and resistance to pin-holing typical of metallised films to form an extremely high opacity light-blocking layer.

Yet further, the invention can provide for a manufacturing technique for high opacity scratch-off foils made by using alternating layers of metal and light absorbing scratch-off adhesive, with for example a minimum of two layers of each, to give enhanced optical density and retained optical density and retained opacity when bent or otherwise deformed. As such, the invention provides for a scratch-off foil or scratch card made using this method or containing this structure.

Preferably, the first layer of scratch-off adhesive (the interlayer) can have a high optical density—typically obtained with carbon dispersion in the adhesive—as black as possible.

It should be appreciated that the relatively soft scratch-off coating can achieve its relatively softness through inclusion of a soft compound such as latex or wax Yet further, the scratch-off coating can comprise a heat-activated adhesive which can be either solvent or water-based and the fillers employed can comprise relatively large fillers such as ditania and/or ceramics having dimensions in the order of 2-5 microns.

BRIEF DESCRIPTION OF THE DRAWINGS

The invention is now described further, by way of example only, with reference to the accompanying drawings in which.

DESCRIPTION OF THE SPECIFIC EMBODIMENTS

Figure 1A:
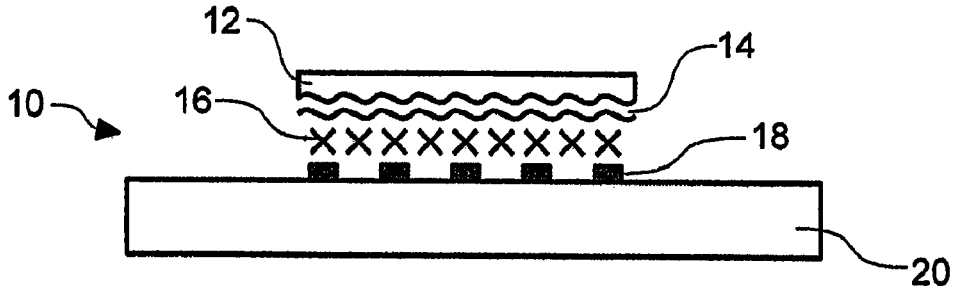
Fig.1A PRIOR ART
FIG. 1*a* shows a conventional scratch card with a conventional single aluminium layer scratch foil protecting a PIN number and FIG. 1*b* shows the result of aluminium layer cracking on bending and resulting number read out under bending test.

Turning first to FIG. 1*a*, there is illustrated a data protection device 10 according to an embodiment of the present invention and which comprises a holographic layer 12, located on a single aluminium layer 14 which serves, by way of a scratch-off adhesive layer 16 cover PIN numbers 18 printed on a substrate card 20.

Figure 1B:
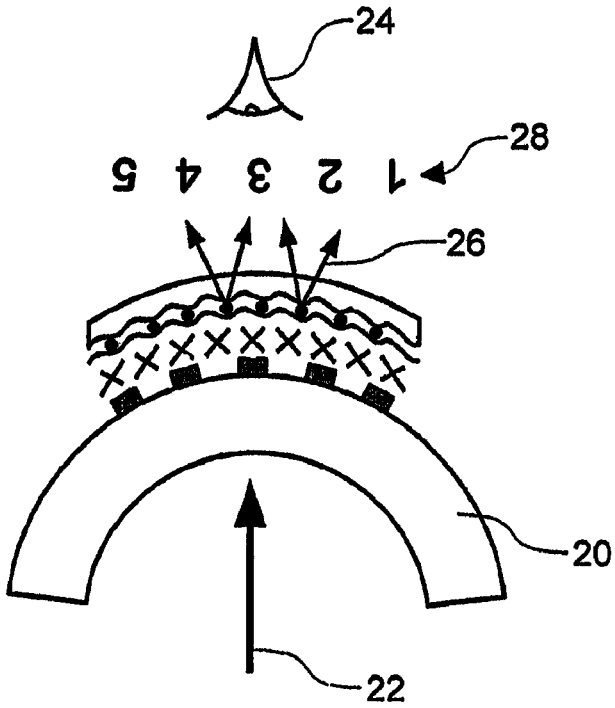
Fig.1B PRIOR ART

Referring to FIG. 1*b*, the device of FIG. 1*a* is shown in a manner in which the substrate card 20 is deformed, i.e. bent such that when a high intensity light 22 is directed through the structure, the deformation of the structure serves to cause microcracks within the aluminium layer 14 such that light 26 can escape therethrough such that, when viewed from a viewing position 24, light 26 escaping through the microcracks can serve to provide an image 28 indicative of the PIN number 18.

Figure 2A:
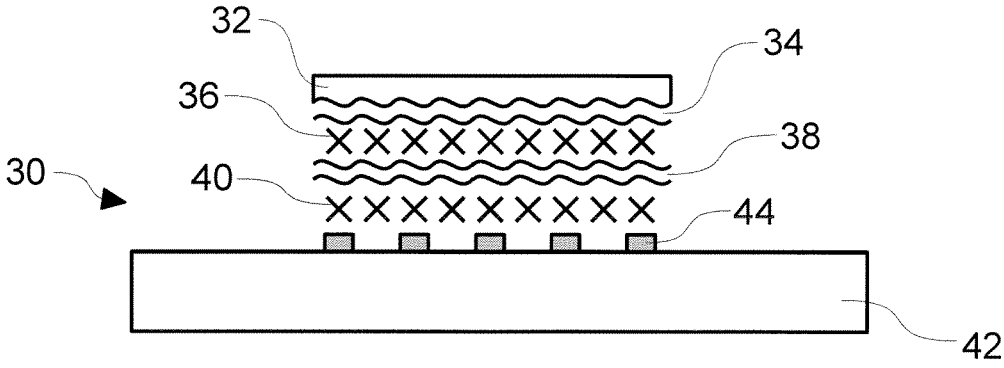
FIG. 2*a* illustrates an improved scratch card with the new multiple aluminium layer and light blocking scratch off adhesive layers protecting a PIN number and FIG. 2*b* shows the result of bending but wherein cracking in aluminium layers does not occur and any light leakage is absorbed by the light absorbing interlayer in the same place so maintaining opacity and defeating number read out under extreme bend test.
Figure 2B:
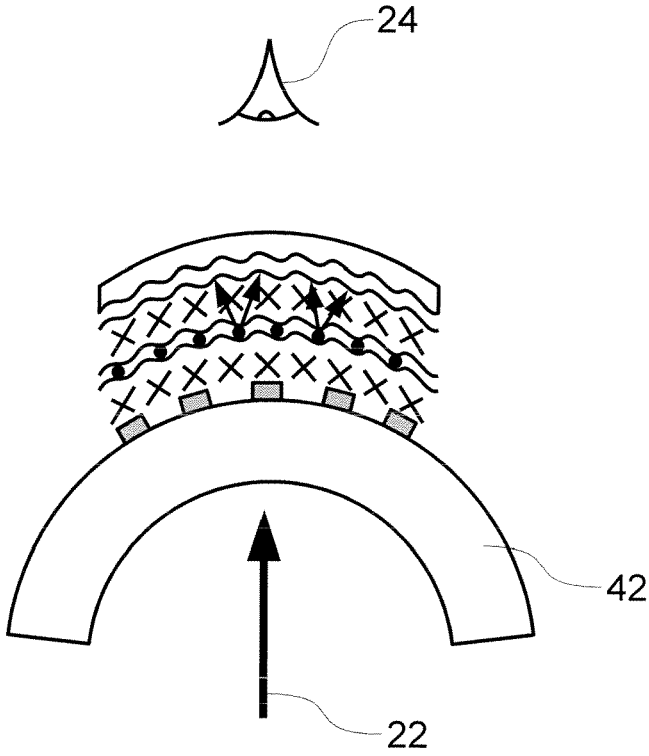

Turning now to FIGS. 2*a* and 2*b*, there is illustrated an embodiment according to an example of the present invention.

Here the structure 30 again comprises an holographic layer 32 on a first aluminium layer 34, but which first aluminium layer 34 is separated from a second aluminium layer 38 by way of a blackened and generally a opaque scratch off adhesive layer 36.

The second aluminium layer 38 likewise overlays, by way of a scratch-off adhesive layer 40, a PIN number 44 comprising the data to be secured.

This time, and with reference to FIG. 2*b*, when the substrate card 42 is deformed to bending, the light 22 directed thereto, and viewed from a viewing position 24 does not escape through the deformed layers of the structure since any microcracks appearing within both the first and second aluminium layers 34, 38, will not be aligned such that it does not prove possible to discern the data represented by the PIN number 44.

Figure 3:
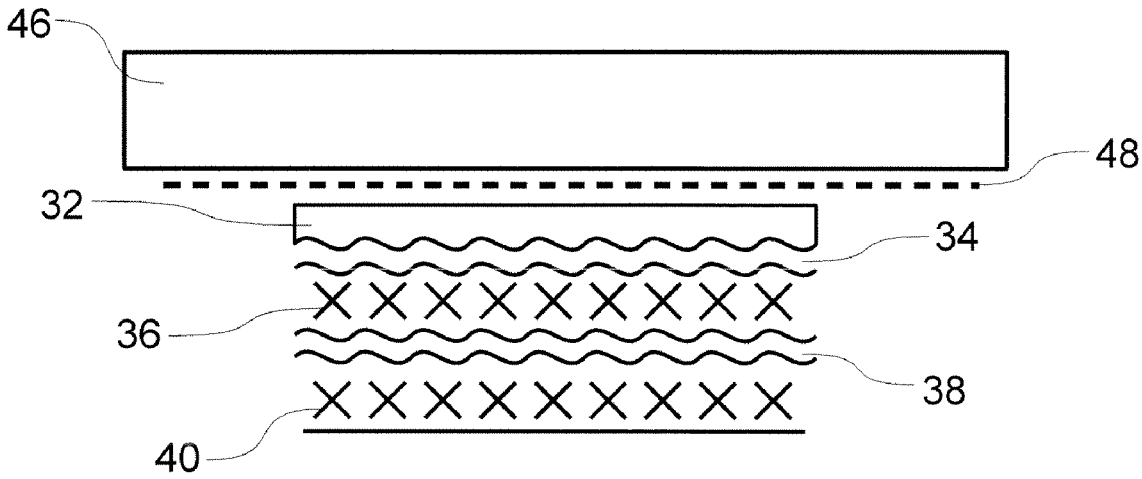
FIG. 3 shows the construction of new high opacity scratch off foil.

The overall structure of the embodiment illustrated in FIGS. 2*a* and 2*b* of the present invention is shown further with reference to FIG. 3.

Here, the layered structure 32-40 is shown bonded to a carrier layer 46 by way of a release layer 48.

As will be appreciated, the present invention provides for a new structure of scratch-off foil where the various layers are arranged to enable the foil to withstand and pass a test involving light transmission coupled with bending of the foil-bearing item. This is done by using two aluminium layers within the structure separated by a few micron layer of light blocking high opacity scratch off coating which increase the flexibility of the structure and allows the aluminium layers to stretch and crack but ensures that because two (or more) aluminium films are involved the cracks tend not line up in transmission and hence the overall light through put though the cracks is greatly reduced and this new structure of card now has improved opacity retention on bending tests The typical construction according to the invention can be—hot stamping foil carrier (PET), release, then the layers transferred onto card namely emboss lacquer carrying micro replicated surface relief diffractive image, first metallised aluminium layer, first intermediate scratch-off adhesive spacer layer to add elasticity—typically a few microns (3-8 um) of one form of scratch off adhesive, typically a high opacity black light absorbing scratch-off adhesive, second metallised aluminium layer to add opacity under bending conditions, the second scratch-off adhesive layer to affix scratch foil over the PIN number, typically 4-13 um thickness. Such an example of this invention is characterised as containing two separate aluminium layers separated by a small distance using a flexible high opacity light absorbing separation layer to allow the aluminium layers to crack in different places under stretching and bending and so as to maintain opacity under bending.

As noted, in various embodiments metals other than aluminium could give different effects, for example, copper for a gold effect, or alloys such as an alloy of copper—aluminium also for a gold effect or chrome for a darker effect or chrome aluminium alloys.

In the illustrated embodiment the first layer of scratch-off adhesive (the interlayer) has a high optical density to ensure it is light absorbing—typically obtained with carbon dispersion in the adhesive—so the adhesive is made as high optical density (i.e. as black) as possible.

Also provided is a material of enhanced optical opacity, having such a construction, and employing such a technique of layering metal layers with spacer layers to provide a material of enhanced opacity and enhanced bend resistance and resistance to pin-holing typical of metallised films to form an extremely high opacity light blocking layer.

To summarise therefore, the invention provides for an optically variable diffractive scratch-off foil with very high opacity designed to reduce the light transmission of holographic scratch off foils under bending transmissive techniques particularly useful in the area of anti-counterfeit and authentication by the diffractive image and data protection using scratch-off foils. These scratch-off foils are also tamper evident against removal and alteration as the holographic image is destroyed by any attempt to remove the device. These techniques can also be used to provide increased opacity scratch-off labels. The invention provides for a new structure of scratch-off foil where the layers are adjusted to enable to foil to withstand and pass a test involving light transmission coupled with bending of the card. This is done by using multiple metallic for example aluminium layers within the structure separated by for example a few micron layer of high opacity light absorbing scratch-off coating which increase the flexibility of the structure and allows the aluminium layers to stretch and crack but ensures that because two (or more) aluminium films are involved the cracks tend not line up in transmission and hence the overall light through put though the cracks is greatly reduced and this new structure of foil now has increased opacity against a light transmission test including bending

What is claimed is:

1. A data protection device comprising an optically variable diffractive scratch-layered structure overlying data to be protected, wherein the device includes first and second opaque metallic layers separated by a high opacity black flexible light-absorbing scratch-off separation layer, and also includes at least one further opaque metallic layer separated from at least one of the first and second opaque metallic layers by a further high opacity black flexible light-absorbing scratch-off separation layer.

2. A device as claimed in claim 1, wherein the said flexible separation layer comprises a scratch-off layer.

3. A device as claimed in claim 1, wherein the said flexible separation layer is of relatively high opacity.

4. A device as claimed in claim 1, wherein the flexible separation layer comprising an adhesive layer.

5. A device as claimed in claim 1, wherein the flexible separation layer achieves its opacity by way of carbon dispersion therein.

6. A device as claimed in claim 1 and comprising a high opacity holographic scratch-off foil device consisting of a first layer containing an embossed diffractive image, a second reflective layer consisting of a vacuum deposited opaque metallic coating, a third high opacity light absorbing soft black frangible scratch-off layer, a second opaque metallic layer and a second scratch off adhesive layer, the structure being such that the opacity of the combination of layers is not degraded by deformation and micro cracking of the opaque metallic layers, wherein the various scratch off adhesive are designed to be frangible and easily removed to reveal underlying data.

7. A device as claimed in claim 6, wherein the soft black frangible scratch off layer has a thickness in the range of 3 to 8 microns.

8. A structure as claimed in claim 6, wherein the light absorbing black frangible scratch off layer is also of an optical density of 1.5 or greater.

9. A device as claimed in claim 6, and containing a multiple number of combination structures of opaque metallic layers and high opacity frangible soft scratch off layer combinations to provide a further enhancement to the optical density of the structure and the maintenance of optical density with bending of the holographic scratch off layer.

10. A device as claimed in claim 1 wherein the opaque metallic material is any of aluminium, chromium or copper.

11. A scratch card containing a scratch off layer protecting data thereof, and comprising a data protection device as claimed in claim 1.

* * * * *